US007967694B2

(12) United States Patent
Voden

(10) Patent No.: US 7,967,694 B2
(45) Date of Patent: Jun. 28, 2011

(54) ROTARY GAME TABLE

(76) Inventor: Justin L. Voden, Waukesha, WI (US)

( * ) Notice: Subject to any disclaimer, the term of this patent is extended or adjusted under 35 U.S.C. 154(b) by 888 days.

(21) Appl. No.: 10/908,842

(22) Filed: May 27, 2005

(65) Prior Publication Data

US 2005/0202884 A1 Sep. 15, 2005

Related U.S. Application Data

(63) Continuation-in-part of application No. 10/768,512, filed on Jan. 29, 2004, which is a continuation-in-part of application No. 10/455,666, filed on Jun. 5, 2003, now Pat. No. 7,762,902, which is a continuation-in-part of application No. 10/337,623, filed on Jan. 7, 2003, now Pat. No. 6,764,409.

(51) Int. Cl.
*A63D 15/04* (2006.01)
*A63D 15/00* (2006.01)
*A63D 13/00* (2006.01)

(52) U.S. Cl. ..... 473/10; 473/14; 473/16

(58) Field of Classification Search ..... 473/1, 4, 473/6, 9, 10, 14–16, 19; 108/1, 11, 12, 19, 108/94; D21/318, 385, 397; 273/309, 108.1
See application file for complete search history.

(56) References Cited

U.S. PATENT DOCUMENTS

| | | | | |
|---|---|---|---|---|
| 122,830 | A | 1/1872 | Heyl | |
| 211,083 | A | 1/1879 | Bensinger | |
| 747,726 | A | 12/1903 | Karhan | |
| 1,353,728 | A * | 9/1920 | Dence | 108/62 |
| 2,008,613 | A * | 7/1935 | Hernes | 108/90 |
| 3,227,105 | A * | 1/1966 | Braude et al. | 108/13 |
| 3,770,334 | A * | 11/1973 | Weber | 312/223.4 |
| 3,815,078 | A * | 6/1974 | Fedrick | 439/501 |
| 3,866,913 | A | 2/1975 | Zimmers et al. | |
| D247,127 | S | 1/1978 | Kavka | |
| 4,305,581 | A | 12/1981 | Neuharth | |
| 4,520,239 | A * | 5/1985 | Schwartz | 191/12.4 |
| 4,552,362 | A * | 11/1985 | Oake | 273/237 |
| 4,722,530 | A * | 2/1988 | Hendon | 273/309 |
| 4,927,140 | A | 5/1990 | Pappas | |
| 5,083,241 | A * | 1/1992 | Foster | 362/33 |
| 5,329,979 | A * | 7/1994 | Miller et al. | 144/329 |
| 5,573,239 | A * | 11/1996 | Ryker et al. | 473/436 |
| 5,829,501 | A * | 11/1998 | DeVito | 144/286.1 |
| 5,941,778 | A * | 8/1999 | Vasalech | 473/1 |
| 6,007,438 | A * | 12/1999 | Harrell | 473/496 |
| 6,053,587 | A * | 4/2000 | Boerder | 312/249.12 |
| 6,095,156 | A * | 8/2000 | Smith, II | 132/286 |
| 6,109,607 | A | 8/2000 | Cartwright et al. | |
| 6,155,564 | A | 12/2000 | Tsai | |
| 6,170,775 | B1 * | 1/2001 | Kovacik et al. | 242/404 |
| 6,237,659 | B1 * | 5/2001 | Francis | 144/286.1 |
| 6,273,354 | B1 * | 8/2001 | Kovacik et al. | 242/404 |
| 6,347,797 | B1 | 2/2002 | Tsai | |
| 6,349,939 | B1 * | 2/2002 | Tsai | 273/108.1 |
| 6,439,360 | B1 * | 8/2002 | Miller | 191/12.2 R |
| 6,452,108 | B1 * | 9/2002 | Major | 174/135 |

(Continued)

*Primary Examiner* — Mitra Aryanpour
(74) *Attorney, Agent, or Firm* — Michael Best & Friedrich LLP

(57) ABSTRACT

A rotary game table includes at least two of a pool table surface, an air powered hockey table surface, a gambling surface, a gaming surface, and a table soccer surface. The combination game table is pivotally supported by a side support member at each end thereof. A plug assembly is connected to rotary game table and communicates electrical power thereto.

20 Claims, 17 Drawing Sheets

U.S. PATENT DOCUMENTS 6,764,409 B1 7/2004 Voden
6,845,575 B1 * 1/2005 Hwang ..... 191/12.4
6,848,937 B1 * 2/2005 Hsiao ..... 439/528
6,854,575 B1 * 2/2005 Desormeaux et al. ..... 191/12.4
2004/0067796 A1 * 4/2004 Murrey et al. ..... 473/4
2004/0132537 A1 7/2004 Voden
2005/0049056 A1 3/2005 Padilla
2005/0064945 A1 3/2005 Voden

* cited by examiner

ROTARY GAME TABLE

CROSS-REFERENCES TO RELATED APPLICATIONS

This is a continuation-in-part application and claims priority of U.S. Ser. No. 10/768,512 filed Jan. 29, 2004 which is a continuation-in-part application taking priority from U.S. Ser. No. 10/455,666, filed on Jun. 5, 2003. U.S. Ser. No. 10/455,666 is a continuation-in-part application and claims priority of U.S. Ser. No. 10/337,623, filed 2003-01-07, now U.S. Pat. No. 6,764,409, issued Jul. 20, 2004.

BACKGROUND OF THE INVENTION

1. Field of the Invention

The present invention relates generally to game tables and more specifically to a rotary game table, which provides at least two of a pool table, an air powered hockey table, a gaming table, or table soccer table.

2. Discussion of the Prior Art

It appears that the prior art does not disclose a combination pool table and air powered hockey table in one rotatable structure. U.S. Pat. No. 4,305,581 to Neuharth discloses a pivotable playing table. A billiard table is pivotally supported by two pedestals in either a horizontal or vertical orientation. U.S. Pat. No. 6,155,564 to Tsai discloses a rotary game table having an air blower system. A double sided game surface is pivotally retained in a game table base. The double sided game surface includes table soccer on one surface and an air powered hockey table on the opposite surface. U.S. Pat. No. 6,347,797 discloses a game table with using modes convertible by way of rotation. A table body is pivotally retained in a table frame. In one embodiment, the table body includes table soccer on one surface and a pool table on the opposite surface.

Accordingly, there is a clearly felt need in the art for a rotary game table, which provides a combination game table having two of a pool table, an air powered hockey table, a gaming table, and a table soccer table.

SUMMARY OF THE INVENTION

The present invention provides a rotary game that is rotated to provide two of the following: a pool table, an air powered hockey table, a gaming table, or table soccer. A rotary game table includes a combination game table two side support members and at least one cross member. In one embodiment, the combination game table includes a pool table surface formed on one side of the combination game table and an air powered hockey table surface formed on the opposite side. A plurality of pool ball pockets is formed in the pool table surface. Each pool ball pocket is sized to receive normal sized pool balls. A net is preferably used to capture a billiard ball that falls into one of the pool ball pockets. However, other devices may be used to capture a billiard ball that falls into a pool ball pocket, such as a plastic molded pocket or a pool ball return.

The air powered hockey table surface includes a plurality of air holes formed through the table surface. A diffuser plate is disposed below the air powered hockey table surface. An air blower is retained between the game surfaces of the table. Preferably, the air blower is removably attached to a drawer slidably attached to the combination game table. An air hole is formed through the diffuser plate to receive an output of the air blower. The air blower draws air from inside the combination game table and pushes the air through the plurality of air holes. A puck slot is disposed on each end of the air powered hockey table to provide scoring in a game of air powered hockey.

Preferably, at least one accessory retainer is terminated on each end with a single side support member. The at least one cross member is also terminated on each end by a single side support member. The combination game table is pivotally retained by a single side support member on each end thereof. At least one locking pin device is disposed in at least one of the side support members. Each locking pin device is preferably spring loaded such that a spring pin is in a normally extended position. At least one pin cavity is formed in an end of the combination game table to receive the at least one locking pin. The at least one locking pin is withdrawn from the at least one pin cavity to allow the game table to be rotated. A separate locking pin may also be used that is withdrawn from each side support member.

A second embodiment of a rotary game table includes a combination game table, two side support members, at least two pivotal support arms and at least one cross member. Preferably, at least one accessory retainer acts as the at least one cross member. The at least one accessory retainer is terminated on each end with a single side support member. The combination game table is pivotally retained by one side support member on each end thereof. Each pivotal support arm is pivotally attached to one end of one side support member. The pivotal support arms are swung such that they are parallel with the side support members when rotating the combination game table. Each pivotal support arm is attachable to a single accessory retainer with any suitable quick release fastener. The at least one locking pin device may also be disposed in each side support member.

A third embodiment of a rotary game table includes a combination game table, two side support members, and at least one cross member. The at least one cross member is terminated on each end with a single side support member. The combination game table is pivotally retained by one side support member on each end thereof. At least one locking pin device is disposed in at least one of the side support members.

A pivotal support arm may be substituted for the at least one locking pin device. Each pivotal support arm would be pivotally attached to one end of one side support member. The pivotal support arms are swung such that they are parallel with the side support members when rotating the combination game table. Each pivotal support arm is attachable to a single cross member with any suitable quick release fastener.

At least one of the two side support members is preferably configured to retain game accessories such as a plurality of billiard balls, cue sticks, a rack, a puck, hockey paddles, a table soccer ball, gaming accessories, and/or gambling accessories. A plurality of game accessories is defined by at least two billiard balls.

A fourth embodiment of a rotary game table includes a combination game table, two side support members, and at least one cross member. The at least one cross member is terminated on each end with a single side support member. The combination game table is pivotally retained by one side support member on each end thereof. Preferably, two support latches are in each side support member. One of the two side support members is preferably configured to retain game pool accessories such as a plurality of billiard balls, a rack and a brush, and the other one of the two side support members is preferably configured to retain hockey accessories such as two paddles and a puck.

A gaming table surface may be substituted for any of the air hockey table surface, a pool table surface, and a table soccer surface. The gaming table surface includes a gaming pocket formed in the combination game table and at least one gaming insert. The gaming insert is preferably retained with a plurality lock clips. A dealer chip holder and player chip holders are also formed adjacent the gaming table surface.

A table soccer game may be substituted for any of the air hockey table surface, a pool table surface, and a gaming table surface. The table soccer game is preferably regulation size but other sizes are envisioned and within the scope of the claims. The table soccer game includes a game cavity, a plurality of moveable rods and two rod retainers. The game cavity is formed below the surface of the combination game table. A first rod flange and a second rod flange form the side boundaries of the game cavity. The plurality of moveable rods is pivotally and slidably retained by the first and second rod flanges. A first rod retainer is pivotally attached to one side rail of the combination game table, adjacent the first rod flange and a second rod retainer is pivotally attached to an opposite side of the combination game table, adjacent the second rod flange. The first and second rod retainers reduce the amount of sliding of the plurality of moveable rods, when the combination game table is revolved.

Accordingly, it is an object of the present invention to provide a rotary game table, which provides any combination of a pool (billiards) table, an air powered hockey table, a gaming table, and a table soccer table on a combination game gaming table.

These and additional objects, advantages, features and benefits of the present invention will become apparent from the following specification.

BRIEF DESCRIPTION OF THE DRAWINGS

The drawings illustrate several preferred embodiments presently contemplated for carrying out the invention.

In the drawings.

DETAILED DESCRIPTION OF THE PREFERRED EMBODIMENTS

Figure 1:
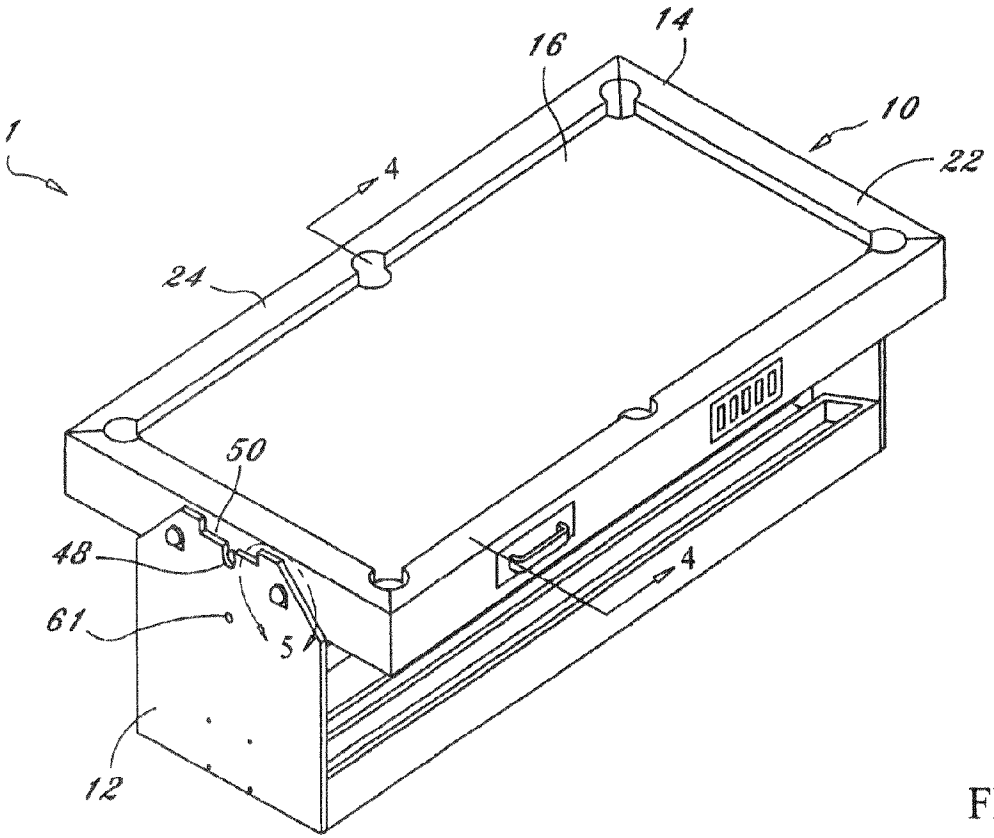
FIG. 1 is a perspective view of a rotary game table in accordance with the present invention.
Figure 2:
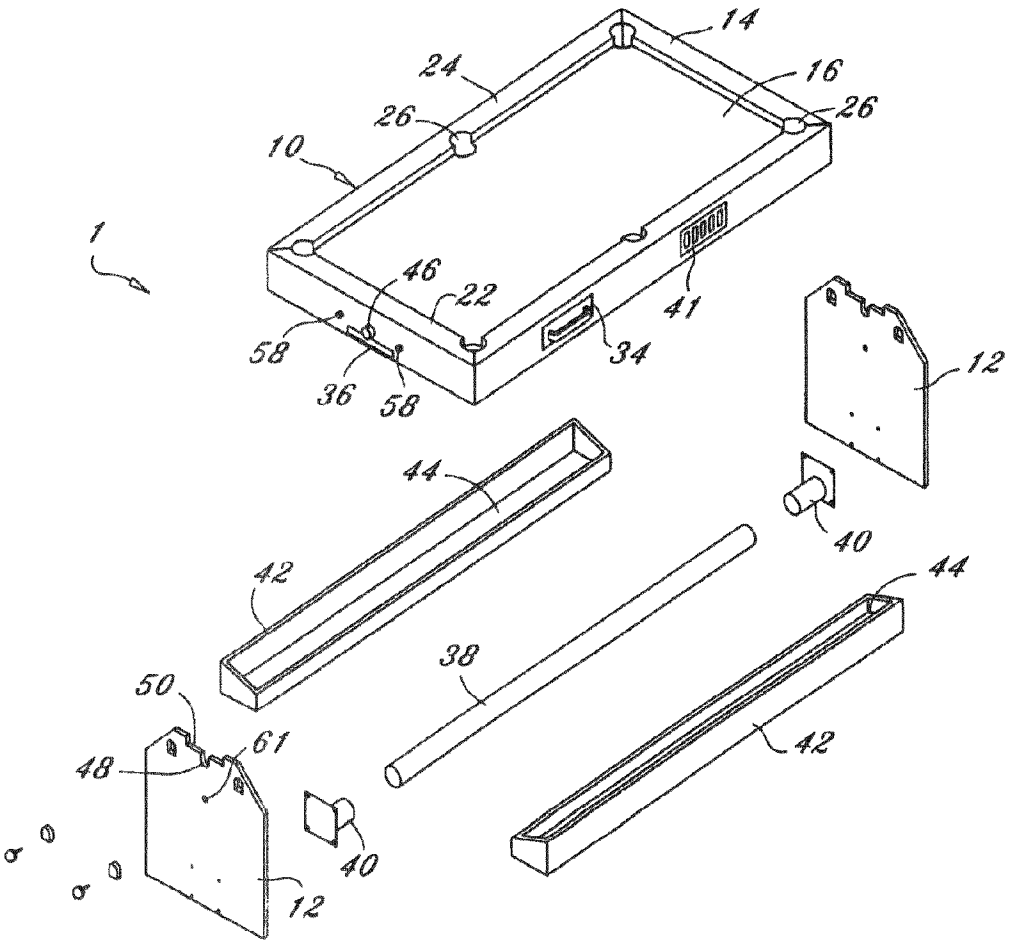
FIG. 2 is a partially exploded perspective view of a rotary game table in accordance with the present invention.
Figure 3:
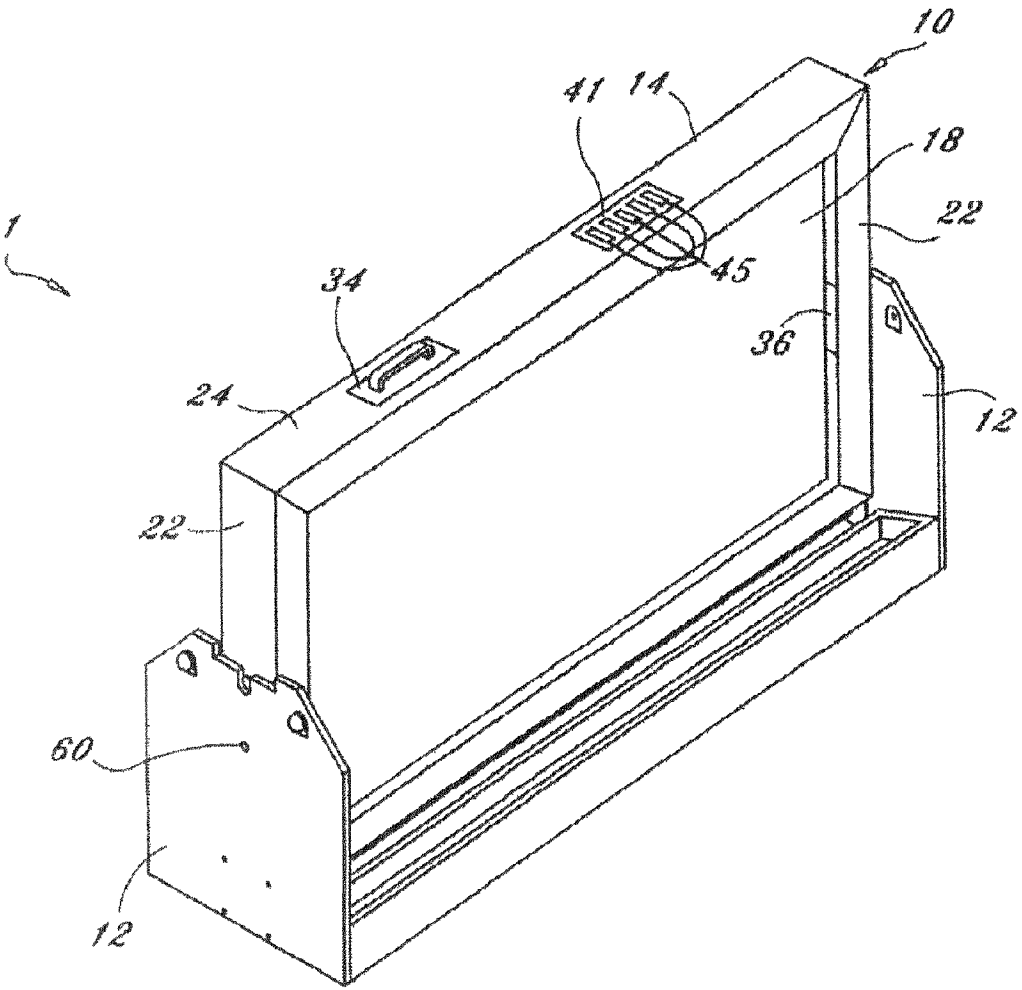
FIG. 3 is a perspective view of a rotary game table with a combination game table in a vertical orientation in accordance with the present invention.
Figure 4:
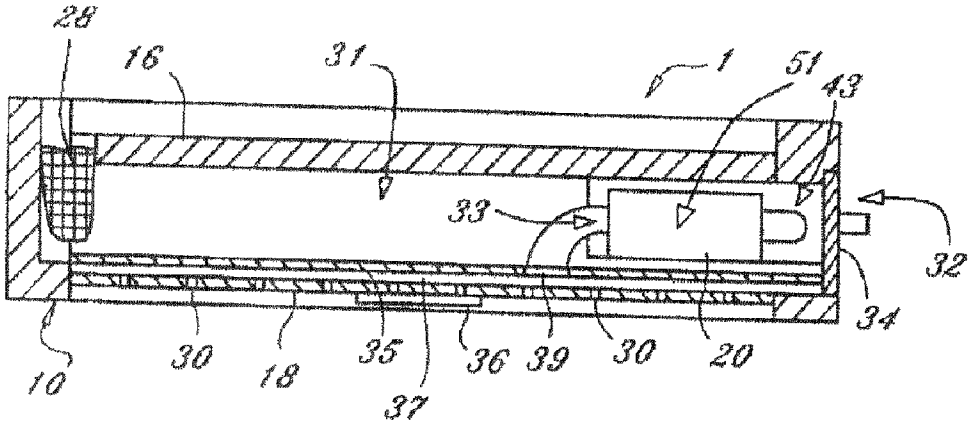
FIG. 4 is a cross-sectional view of a combination game table of a rotary game table in accordance with the present invention.

With reference now to the drawings, and particularly to FIG. 1, there is shown a perspective view of a rotary game table 1. With reference to FIGS. 2-4, the rotary game table 1 includes a combination game table 10, two side support members 12, and at least one cross member. The combination game table 10 includes a game frame 14, a pool table surface 16, an air powered hockey surface 18 and an air blower 20. The pool table surface 16 is formed on one side of the combination game table 10 and air powered hockey table surface 18 formed on the opposite side. The game frame 14 preferably includes two end frame members 22 and two lengthwise frame members 24. The two end frame members 22 are attached to the two lengthwise frame members 24 with any acceptable fastening process, such as glue or fasteners.

A perimeter of the pool table surface 16 is preferably attached to an inside perimeter of the game frame 14 with threaded fasteners, but other attachment methods may also be used. The air powered hockey surface 18 is preferably attached to an inside perimeter of the game frame 14 with glue, but other attachment methods may also be used. Pool ball pockets 26 are formed in the end frame members 22, the lengthwise frame members 24 and the pool table surface 16. The pool ball pockets 26 are formed substantially through a height of the end and lengthwise frame members. Preferably, a net 28 is attached to a wall of each pool ball pocket 26 to capture a billiard ball that falls therein.

The air powered hockey table surface 18 includes a plurality of air holes 30 formed therethrough. A diffuser plate 35 is disposed below the air powered hockey table surface 18 such that an air gap 37 is maintained therebetween. A space, cavity, or pocket 31 is formed between pool table surface 16 and hockey table surface 18 and is constructed to receive air blower 20 therein. The air blower 20 is preferably retained in a drawer 34 slideably attached to table 10 between the pool and air powered hockey table surfaces. Alternatively, air blower 20 could simply be disposed in space 31 without drawer 34. An air hole 39 is formed through the diffuser plate 35 to receive an output from an outlet 33 of the air blower 20. The air blower 20 draws air through an inlet 43 from cavity 31 inside the combination game table 10 and preferably through at least one air vent 41 formed through the frame 14. Air vent 41 includes a plurality of openings 45 fluidly connecting cavity 31 to atmosphere. The air output from the air blower 20 flows through the air hole 39 into the air gap 37 created by the diffuser plate 35 and through the plurality of air holes 30 in the air powered hockey table surface 18. The drawer 34 allows air blower 20 to be quickly removed from the combination game table 10 if replacement is required. A puck slot 36 is formed through each end frame member 22 to enable scoring in a game of air powered hockey.

Figure 4A:
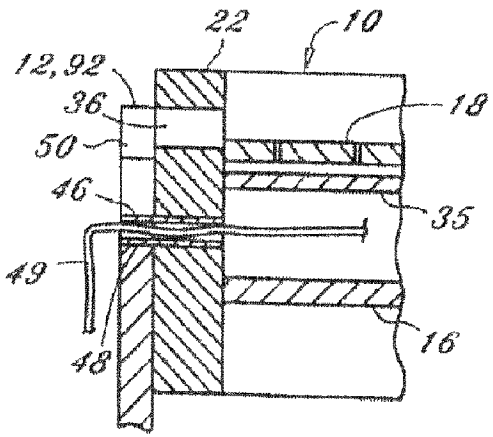
FIG. 4*a* is a cross-sectional view of an electrical cord of an air blower routed through a pivot pin of a rotary game table in accordance with the present invention.

At least one cross member 38 is preferably terminated by an end cap 40 on each end thereof. The end cap 40 is attached to an end of the at least cross member 38 and to one of the two side support members 12 with any suitable fastening method. Preferably, an end of at least one accessory retainer 42 is attached to one of the side support members 12 with any suitable fastening method. Each accessory retainer 42 includes an accessory trough 44. The accessory trough is configured to retain a plurality of game accessories such as a plurality of billiard balls, cue sticks, a rack, a puck, and two hockey paddles. With reference to FIG. 4*a*, an electrical cord 49 is routed through a tubular pivot pin 46. The pivot pin 46 extends from each end of the combination game table 10. A pivot slot 48 is preferably formed in a top of each side support member 12, 92 to pivotally receive the pivot pin 46. The other pivot pin 46 does not have to be tubular, but may be solid. A puck clearance slot 50 is also formed in a top of each side support member 12, 92. The electrical cord 49 of the air blower 20 is preferably run through one of the pivot pins 46 and is electrically connected to a motor 51 air blower 20 as shown in FIG. 4.

Figure 4B:
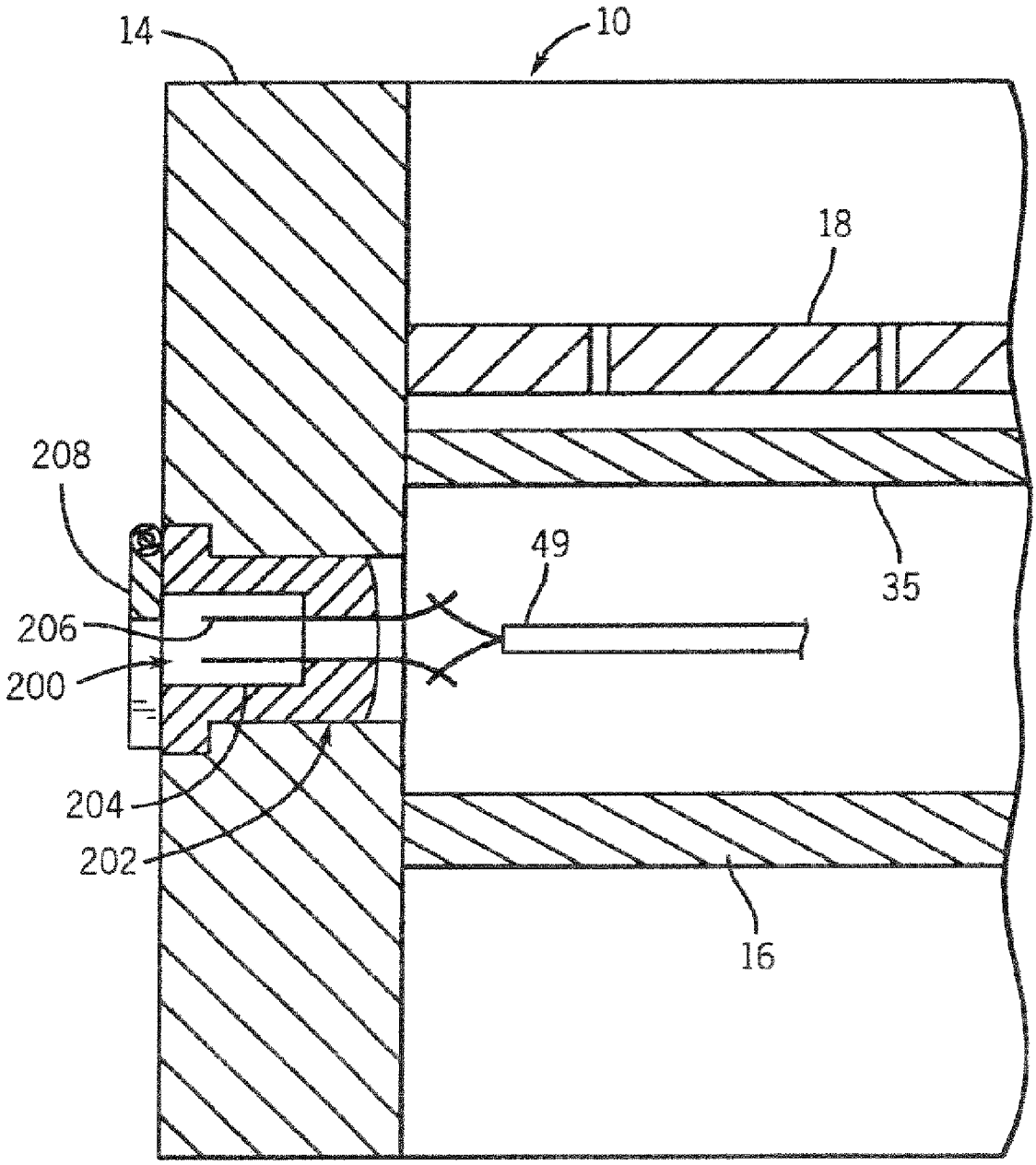
FIG. 4*b* is a cross-sectional view of a plug formed in a frame member of the combination table for receiving an electrical cord to power an electrical device, such as an air blower, of a rotary game table.

With reference to FIG. 4*b*, electrical cord 49 is connected to a plug 200. The plug 200 is attached to game frame 14 at an opening 202 formed therethrough. Plug 200 includes a cavity 204 and a plurality of prongs 206 which extend into cavity 204. Prongs 206 are configured to engage an electrical cord and communicate power from the electrical cord to cavity 31 of game table 10. A cover 208 is connected to plug 200 and covers prongs 206 when electrical power is not required for game play. In addition to powering air blower 20, plug 200 can be electrically connected to other electronic game components such as a score board or lighting systems.

Figure 4C:
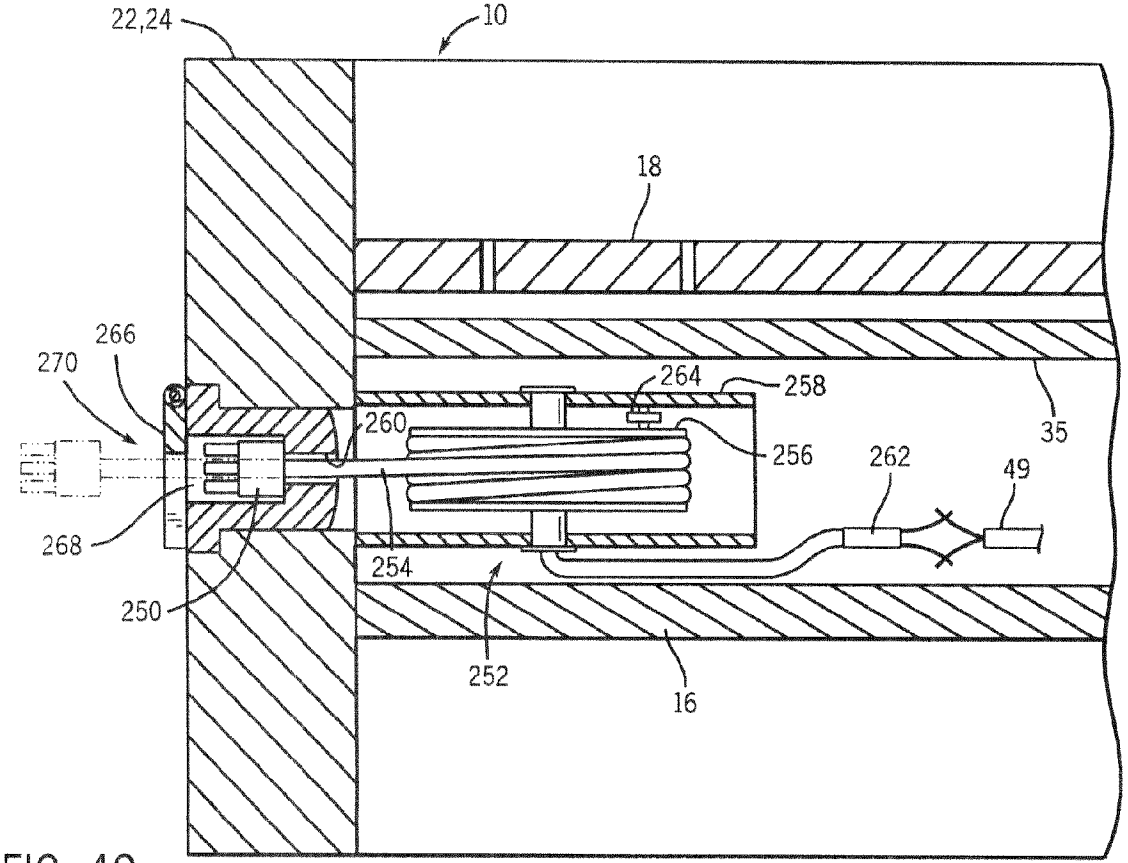
FIG. 4*c* shows a cord retractor for electrically connecting the electrical device to a power source.

FIG. 4*c* shows another embodiment of plug 200. As shown in FIG. 4*c*, a plug 250 is attached to a retractor assembly 252. Retractor assembly 252 includes a power cord 254 removably supported on a carriage 256 rotatably attached to a frame 258. Plug 250 is attached to an end 260 of power cord 254 and can be extended (shown in phantom) from game table 10 to engage an electrical outlet or receptacle. Another end 262 of power cord 254 is electrically connected to electrical cord 49 of air blower 20 or to other desired electrical devices. Retractor assembly 252 includes a latch 264 constructed to engage carriage 256 and secure power cord 254 at a desired extended position. When power is not required for playing of a game, power cord 254 is wound about carriage 256 and is stored on retractor assembly 252. A door 266 is pivotably attached to game table 10 and covers plug 250 when plug 250 in located in a recess 268 of retractor assembly 252. Additionally, door 266 has an optional groove 270 formed therein such that door 266 can be closed with power cord 254 extending therethrough. Such a construction provides a plug assembly that communicates power to cavity 31 without additional electrical cords.

Figure 5:
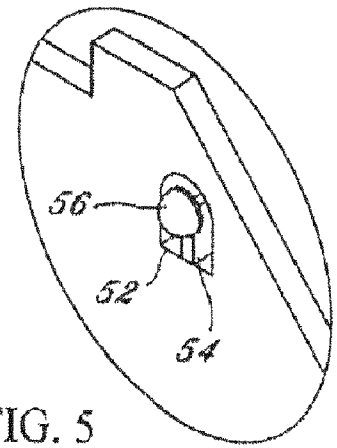
FIG. 5 is an enlarged perspective view of a locking pin device of a rotary game table in accordance with the present invention.

With reference to FIG. 5, at least one locking pin device 52 is disposed in at least one of the two side support members 12. The locking pin device 52 includes a locking body 54 and a spring pin 56. The spring pin 56 is retained in the locking body 54. The spring pin 56 is spring loaded inside the locking body 54 such that the spring pin 56 is biased to an extended position. At least one pin cavity 58 is formed in at least one end of the combination game table 10 to receive the at least one the spring pin 56. The at least one spring pin 56 is withdrawn from the at least one pin cavity 58 to allow the game table to be rotated for storage or to change the game surface.

Figure 6:
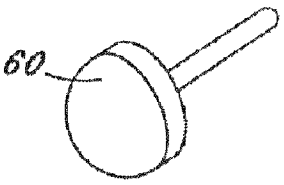
FIG. 6 is an enlarged perspective view of a locking pin of a rotary game table in accordance with the present invention.
Figure 8:
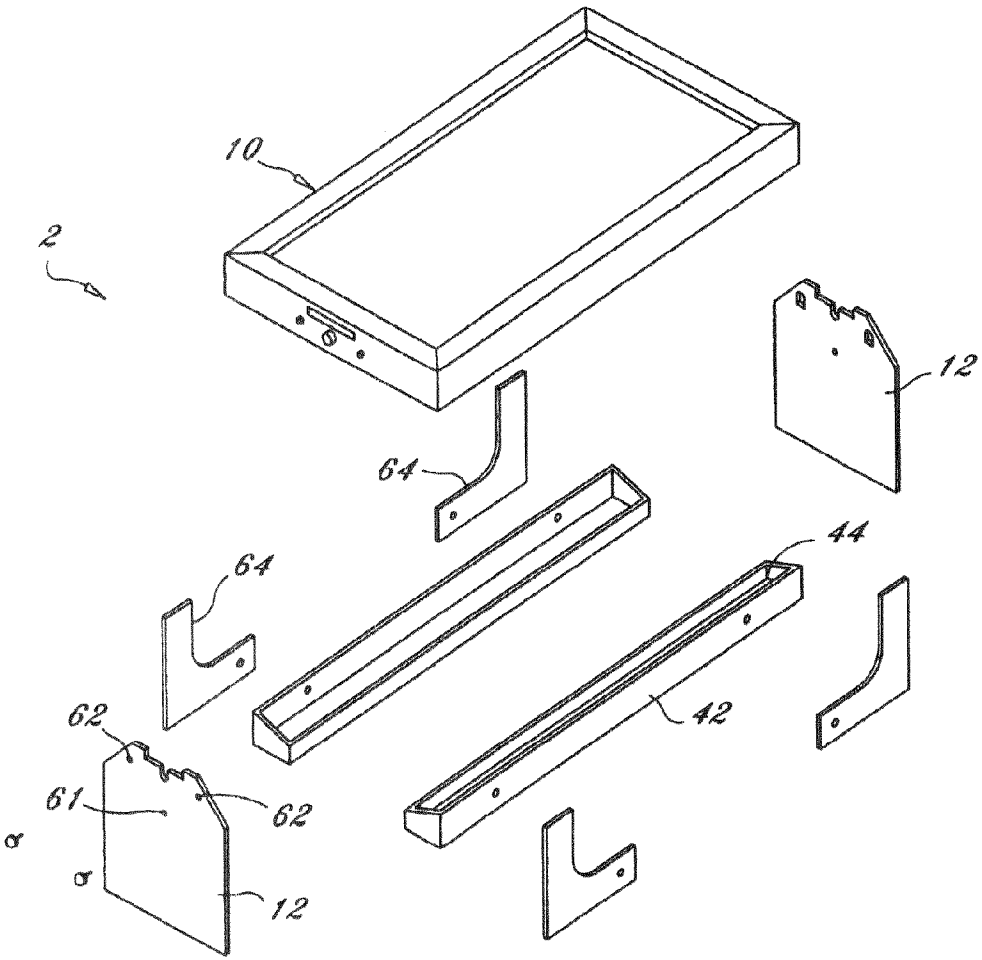
FIG. 8 is a partially exploded perspective view of a second embodiment of a rotary game table in accordance with the present invention.

With reference to FIG. 6, the locking pin device 52 may be replaced with a separate locking pin 60. With reference to FIG. 8, a pin hole 62 is formed through the side support member 12 instead of attaching the locking pin device 52. The locking pin 60 is withdrawn from each side support member 12 to allow rotation of the combination game table 10. To retain the combination game table 10 in a vertical orientation, a pin hole 61 is formed through at least one side support member 12. The pin hole 61 is disposed in the side support member 12 to be concentric with the at least one pin cavity 58. The locking pin 60 is inserted through the pin hole 61 and into the at least one pin cavity 58.

Figure 7:
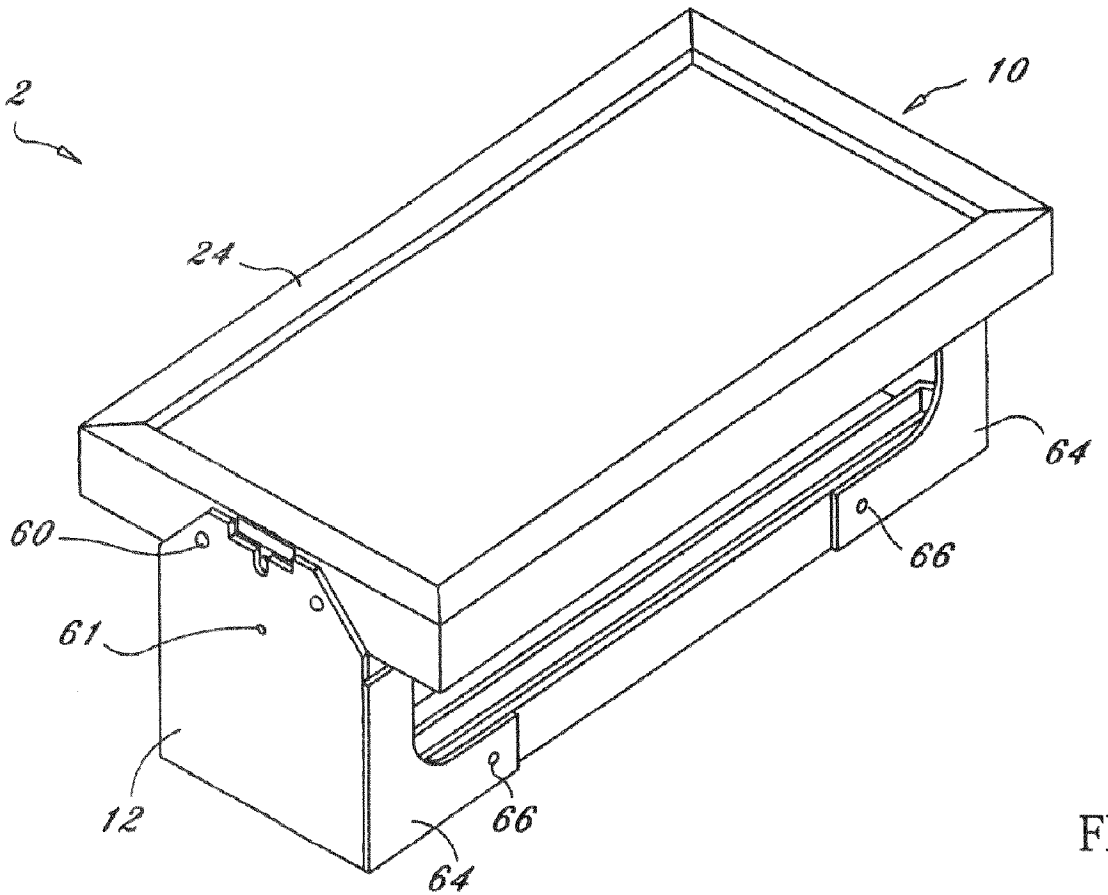
FIG. 7 is a perspective view of a second embodiment of a rotary game table in accordance with the present invention.
Figure 9:
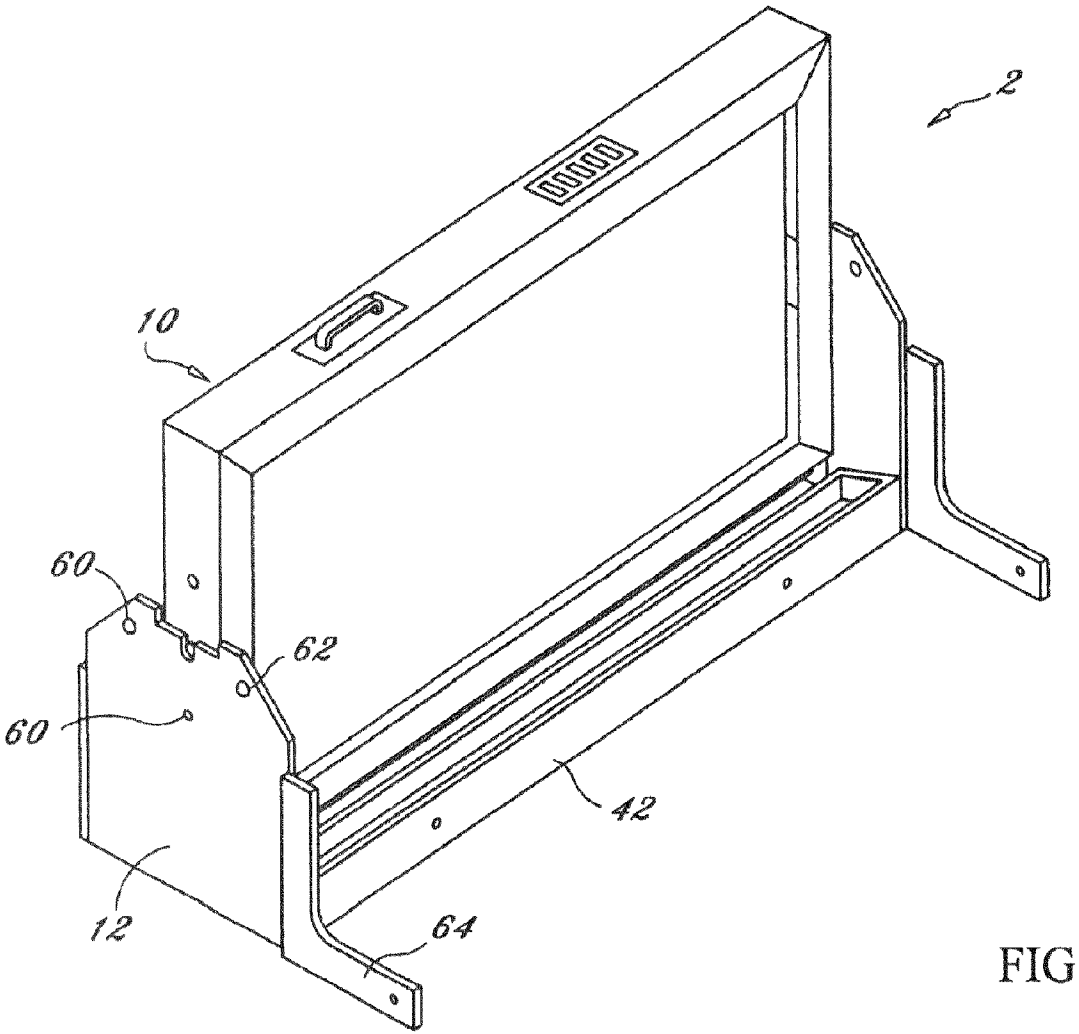
FIG. 9 is a perspective view of a second embodiment of a rotary game table with a combination game table in a vertical orientation in accordance with the present invention.

With reference to FIGS. 7-9, a second embodiment of rotary game table 2 includes a combination game table 10, two side support members 12, at least two pivotal support arms 64 and at least one cross member. Preferably, at least one accessory retainer 42 acts as the at least one cross member. One of the two side support members 12 is attached to each end of the at least one accessory retainer 42 with any suitable fastening process. The combination game table 10 is pivotally retained by a single side support member 12 on each end thereof. Each pivotal support arm 64 is pivotally attached to one end of the side support member 12 with at least one hinge or any other suitable pivotal retention device.

To rotate the combination game table 10, the pivotal support arms 64 are swung outward such that they are parallel with the side support members 12. The pivotal support arms 64 are swung inward to retain the combination game table 10 in a horizontal orientation. Each pivotal support arm 64 is attachable to a single accessory retainer 42 with any suitable quick release fastener 66. Use of the at least two pivotal support arms 64 eliminates the need for the use of locking pin devices 52 or locking pins 60. However, the locking pin devices 52 or locking pins 60 may also be used in conjunction with the four pivotal support arms 64.

Figure 10:
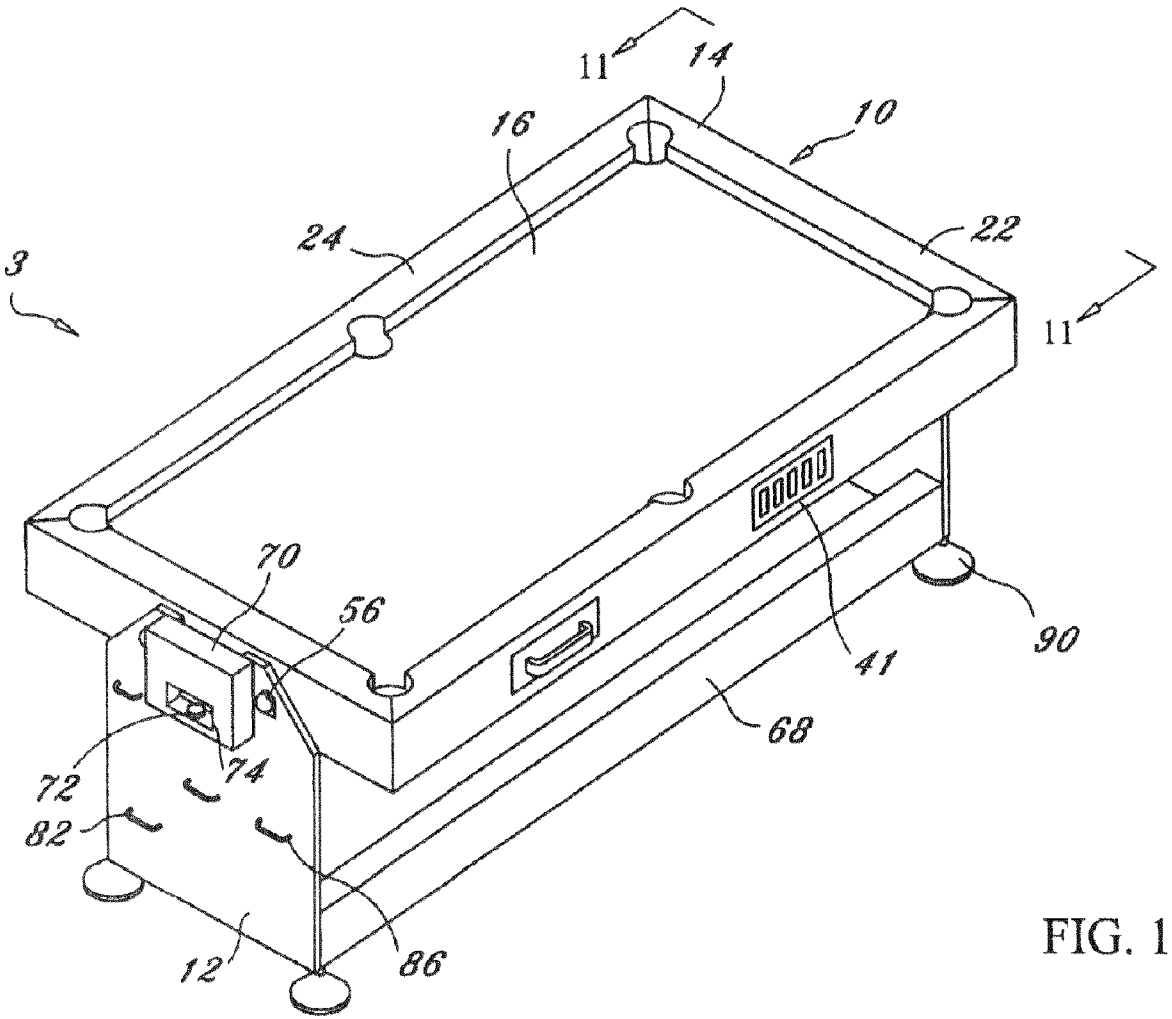
FIG. 10 is a perspective view of a third embodiment of a rotary game table in accordance with the present invention.
Figure 11:
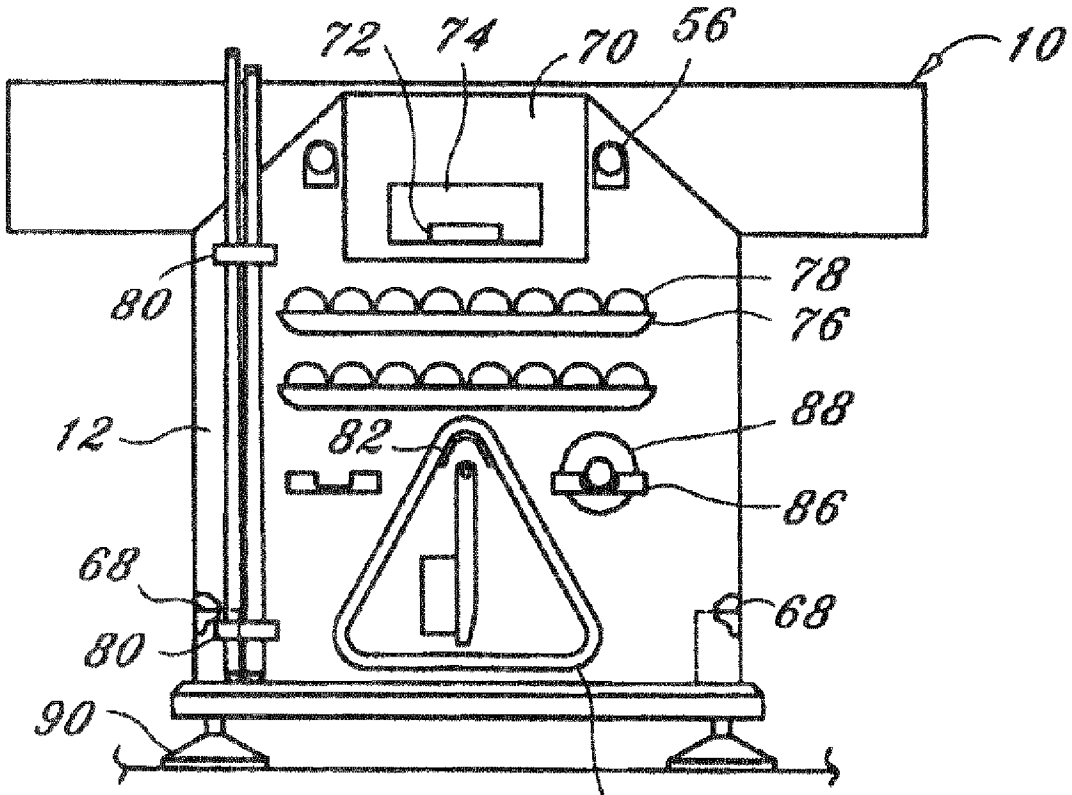
FIG. 11 is a front view of a side support member not shown in FIG. 10 of a third embodiment of a rotary game table in accordance with the present invention.

With reference to FIGS. 10-11, a third embodiment of a rotary game table 3 includes a combination game table 10, two side support members 12 and at least one cross member 68. One of the two side support members 12 is attached to each end of the at least one cross member 68 with any suitable fastening process. The combination game table 10 is pivotally retained by a single side support member 12 on each end thereof.

A hockey puck housing 70 is preferably attached to the support member 12. When a player is successful in scoring, a hockey puck 72 will fall into a hockey puck tray 74 in the hockey puck housing 70. At least one ball tray 76 is preferably mounted to one of the two side support members 12 to retain a plurality of billiard balls 78. At least two pool cue racks 80 are preferably attached to at least one side support member 12. A rack holder 82 is preferably attached to one of the two side support members 12 to retain a rack 84. At least one paddle holder 86 preferably retains a single hockey paddle 88. To rotate the combination game table 10, at least one spring pin 56 of the at least one locking pin device 52 is withdrawn from the at least one pin cavity 58 to allow the game table to be rotated for storage or to change the game surface.

At least one locking pin 60 may be substituted for the at least one locking pin device 52. Further, the at least two pivotal support arms 64 of the second embodiment may also be substituted for the at least one locking pin device 52. Each pivotal support arm 64 would be pivotally attached to a single side support member 12 with at least one hinge or any other suitable pivotal retention device. Each pivotal support arm 64 would be attached to a single cross member 68 with any suitable quick release fastener 66. Four height adjustable feet 90 are preferably used to level the rotary game table 3. The four height adjustable feet 90 may also be used on rotary game tables 1 and 2.

Figure 12:
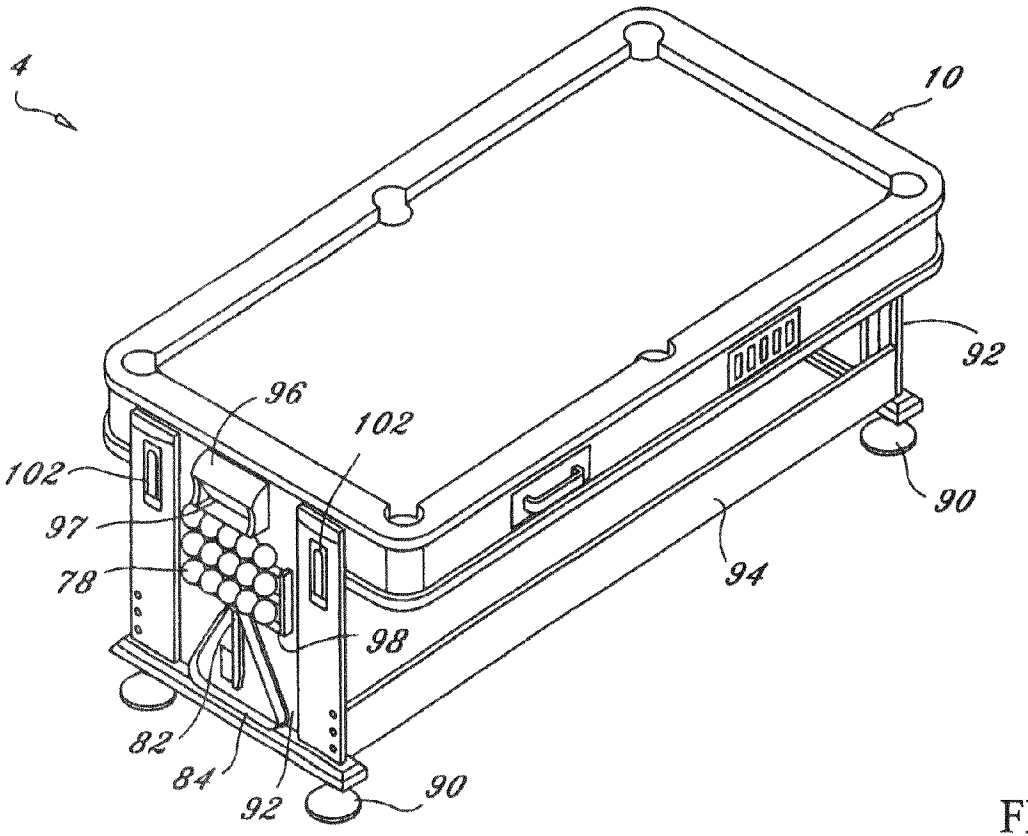
FIG. 12 is a perspective view of a fourth embodiment of a rotary game table in accordance with the present invention.
Figure 13:
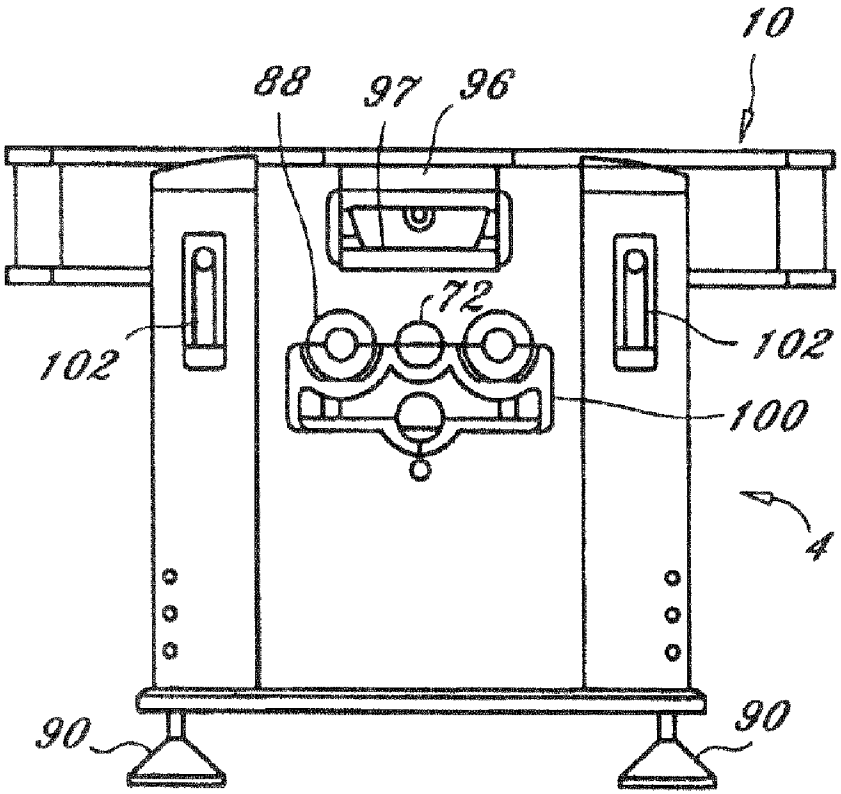
FIG. 13 is a front view of a side support member not shown in FIG. 12 of a fourth embodiment a rotary game table in accordance with the present invention.

With reference to FIGS. 12-13, a fourth embodiment of a rotary game table 4 includes a combination game table 10, two side support members 92 and at least one cross member 94. One of the two side support members 92 is attached to each end of the at least one cross member 94 with any suitable fastening process. The combination game table 10 is pivotally retained by a single side support member 92 on each end thereof.

A hockey puck housing 96 is preferably attached to each side support member 92. When a player is successful in scoring, the hockey puck 72 will fall into a puck tray 97 in the hockey puck housing 96, disposed on each side support member 92. At least one ball tray 98 is preferably mounted to one of the two side support members 92 to retain a plurality of billiard balls 78. A rack holder 82 is preferably attached to one of the two side support members 12 to retain a rack 84. A paddle/puck holder 100 preferably retains the hockey puck 72 and two hockey paddles 88. Four height adjustable feet 90 are preferably used to level the rotary game table 4.

Figure 15:
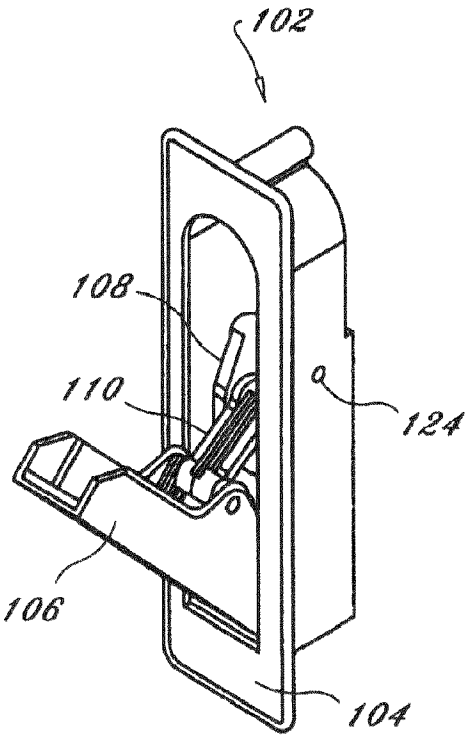
FIG. 15 is a perspective view of a support latch in a retracted orientation of a fourth embodiment of a rotary game table accordance with the present invention.
Figure 14:
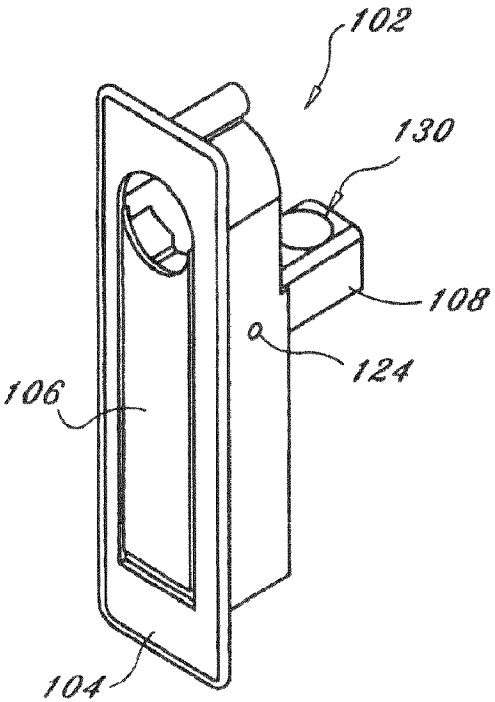
FIG. 14 is a perspective view of a support latch in a locked orientation of a fourth embodiment of a rotary game table in accordance with the present invention.
Figure 16:
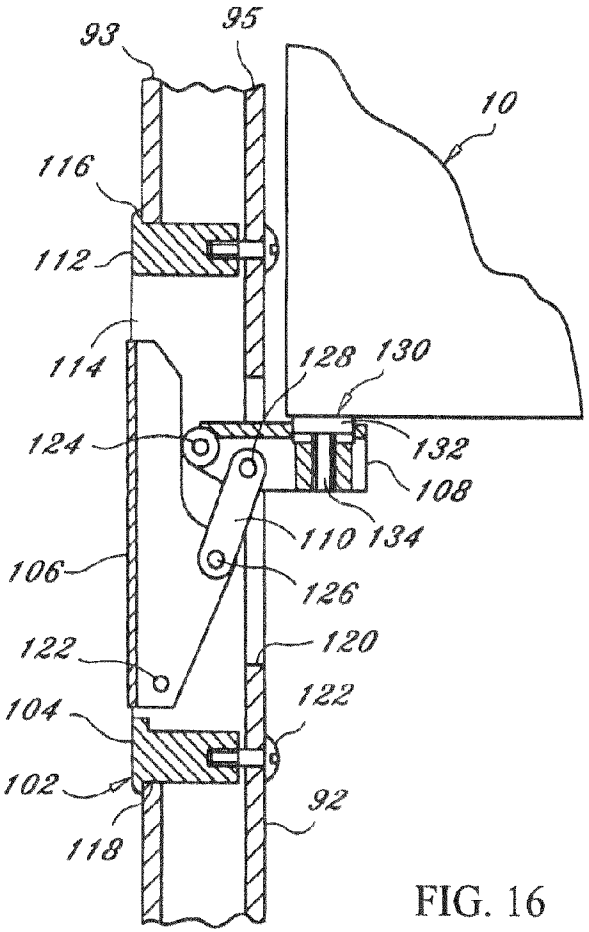
FIG. 16 is a cross-sectional view of a support latch in a locked orientation of a fourth embodiment of a rotary game table in accordance with the present invention.

With reference to FIGS. 14-16, a pair of support latches 102 is retained at least one of the two side support members 92 with any suitable fastening method. The support latch 102 includes a latch frame 104, a latch lever 106, a support link 108, and a latch link 110. The latch frame 104 includes a lever housing 112 with a substantially rectangular opening 114 formed therethrough. A flange 116 is preferably formed on a front periphery of the lever housing 112. The side support member 92 is shown as having a first wall 93 and a second wall 95. However, the side support member 92 may also be solid, or partially hollow and partially solid.

A first latch opening 118 is formed through the first wall 93 to receive the outer periphery of the lever housing 112. A second latch opening 120 is formed through the second wall 95 to provide clearance for the movement of the support link 108. The latch lever 102 is preferably retained in the side support member 92 with at least two fasteners 122. The substantially rectangular opening 114 is sized to receive the latch lever 106. The latch lever 106 is pivotally retained by the latch frame 104 with a lever pin 122 or the like. The support link 108 is pivotally retained by the latch frame 104 with a support pin 124 or the like, adjacent the latch lever 106. One end of the latch link 110 is pivotally retained by the lever 106 with a first link pin 126 and the other end of the latch link 110 is pivotally retained by the support link 108 with a second link pin 128 or the like. FIG. 14 shows the support latch 102 in a locked position and FIG. 15 shows the support latch 102 in a retracted position.

An adjuster 130 extends from a top of each support link 108 and adjusts any slack that may exist between game table 10 and support link 108. The slack adjuster ensures that the combination game table 10 does not rock or wobble, when both support latches 102 are in a locked position. The support link 108 is in a support position, when the support latch is in a locked position and the support link 108 is in a retracted position, when the support latch is in a retracted position. The slack adjuster 130 preferably includes a contact base 132 and a threaded rod 134 extending from a bottom of the contact base 132. The contact base 132 is preferably fabricated from a resilient material to prevent damage to the combination game table 10. A threaded hole is formed in the support link 108 to threadably receive the threaded rod 134. The slack adjuster 130 is rotated upward to prevent the combination game table 10 from pivoting relative to the two side support members 92. The combination game table 10 is rotated by retracting the two support latches 102 in at least one side support member 92. After the combination game table 10 is rotated to the opposite game surface, the support latches 102 are locked.

To retain the combination game table 10 in a vertical orientation, a pin hole would be formed through at least one side support member 92, similar to the pin hole 61 shown in FIG. 7. The at least one pin cavity 58 would be formed in the combination game table 10 as shown in FIG. 2, concentric with the pin hole 61. The locking pin 60 is inserted through the pin hole 61 and into the at least one pin cavity 58 to retain the game table 10 in a vertical orientation.

Figure 17:
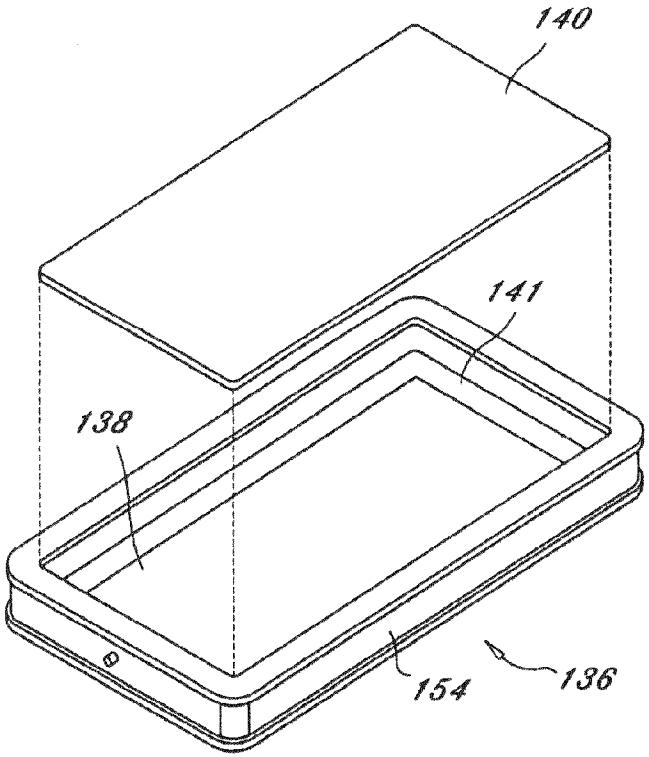
FIG. 17 is a perspective view of a combination game table with a gaming pocket on one side and a pool table surface on the other side thereof of a rotary game table in accordance with the present invention.
Figure 18:
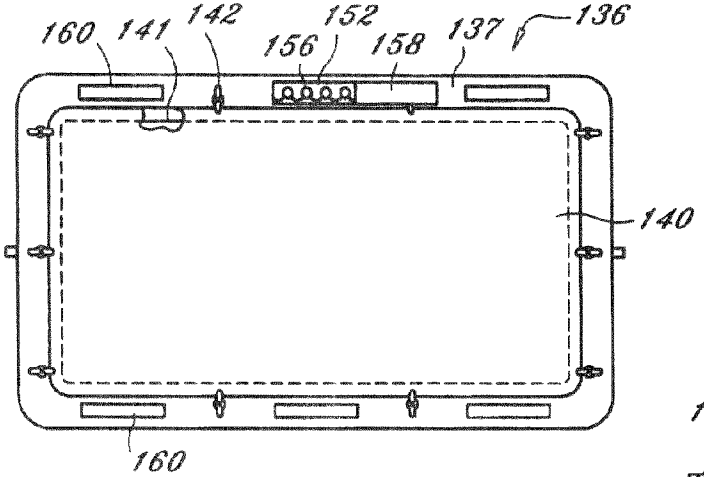
FIG. 18 is a top view of a combination game table with a gaming pocket on one side and a pool table surface on the other side thereof of rotary game table in accordance with the present invention.
Figure 19:
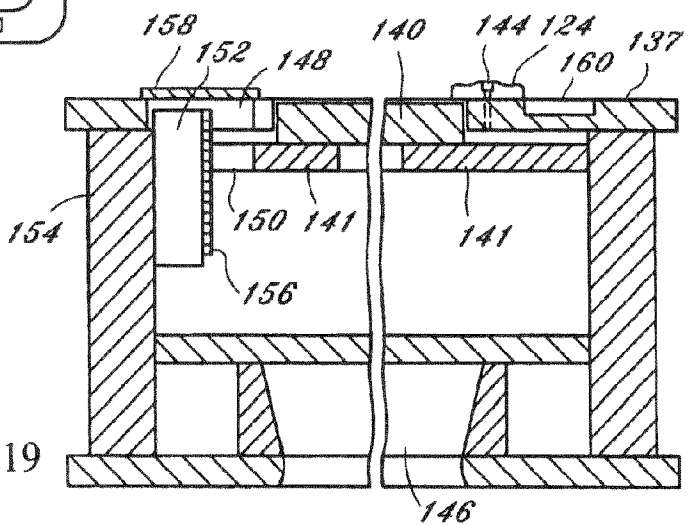
FIG. 19 is an enlarged partial cross-sectional view of a combination game table with a gaming pocket on one side and a pool table surface on the other side thereof of rotary game table in accordance with the present invention.

With reference to FIGS. 17-19, one side of a combination game table 136 includes a gaming pocket 138 that is sized to receive a gaming insert 140. The gaming pocket 138 is formed through a gaming plate 137. The gaming insert 140 may be a roulette table, a roulette wheel, a blackjack table, a craps table or any other gambling table. A support rim 141 preferably supports the gaming insert 140 and acts as a bottom of the gaming pocket 138. A plurality of lock clips 142 is used to retain the gaming insert 140 in the gaming pocket 138. Each lock clip 142 is preferably retained with a screw 144. One end of each lock clip 142 is twisted over the gaming insert 140 to lock thereof in the gaming pocket 138. The lock clip 142 is twisted 90 degrees to allow removal of the gaming insert 140 from the gaming pocket 138. A pool table surface 146 is formed on the opposite surface of the rotary game table 136, but other game surfaces may also be formed thereupon, such as an air hockey surface or a table soccer surface.

A plate opening 148 is formed through the gaming plate 137 and a rim opening 150 is formed through the support rim 141 to provide clearance for a dealer chip holder 152. The plate and rim openings provide enough clearance for a dealer to insert their finger therethrough to retrieve chips from the dealer chip holder 152. The dealer chip holder 152 is attached to a side frame member 154 with any suitable attachment method. The dealer chip holder 152 retains a plurality of chips 156. A chip cover 158 is preferably removably attached to a top of the plate opening 148 with any suitable method. A plurality of chip pockets 160 is formed in the gaming plate 137 to receive an individual player's chips.

Figure 20:
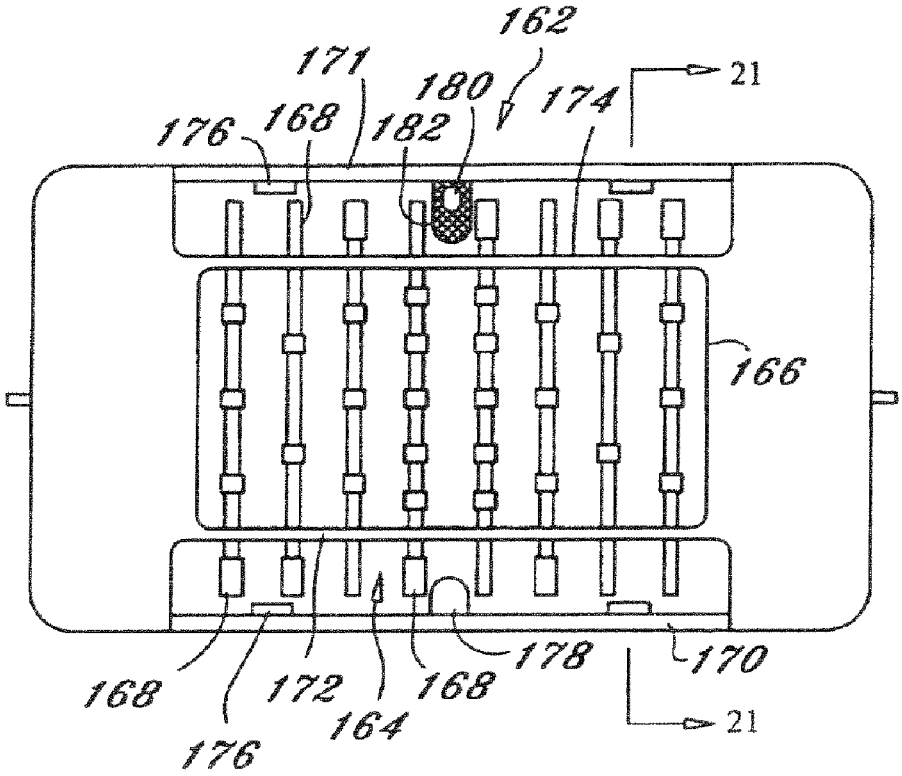
FIG. 20 is a bottom view of a combination game table with a table soccer game on one side and a pool table surface on the other side thereof of a rotary game table in accordance with the present invention.
Figure 21:
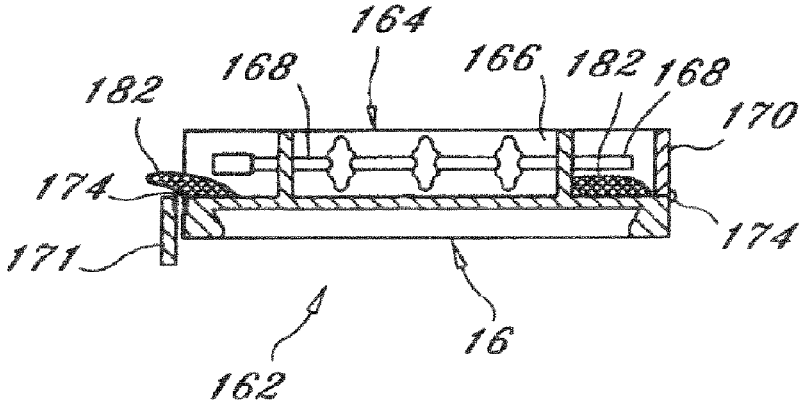
FIG. 21 is an enlarged partial cross-sectional view of a combination game table with a table soccer game on one side and a pool table surface on the other side thereof of a rotary game table in accordance with the present invention.

With reference to FIGS. 20-21, a combination game table 162 includes a table soccer game 164 on one side and a pool table surface 16 on the other side. The table soccer game 164 includes a game cavity 166, a plurality of moveable rods 168 and two rod retainers. The game cavity 166 is formed below the surface of the combination game table 162. A first rod flange 172 and a second rod flange 174 form the side boundaries of the game cavity 166. The plurality of moveable rods 168 is pivotally and slidably retained by the first and second rod flanges.

A first rod retainer 170 is pivotally attached to one side rail of the combination game table 162 with at least one hinge 176, adjacent the first rod flange 172. The second rod retainer 171 is pivotally attached to an opposing side rail of the combination game table 162 with at least one hinge 176, adjacent the second rod flange 174. The first and second rod retainers reduce the amount of sliding of the plurality of moveable rods 168, when the combination game table 162 is revolved. The first and second rod retainers pivot from a lowered position to a raised position. The first and second rod retainers are locked in a raised position with any suitable locking device, such as a latch. A first side pocket opening 178 is formed through the pool table surface 16, adjacent the one side rail and a second side pocket opening 180 is formed through the pool table surface 16, adjacent the opposing side rail. A ball net 182 is attached to a bottom of each side pocket opening 178, 180 with any suitable method to retain a ball during a game of pool.

The heretofore description discloses a plurality of embodiments of the present invention. As one skilled in the art will fully appreciate, the heretofore descriptions of combination game tables are exemplary of multiple embodiments of the present invention. That is, one skilled in the art will appreciate that a combination game table having two of a pool table, a billiards table, an air hockey table, a table soccer table, a gambling table, and a game table has been disclosed and is within the scope of the claims. The claims are not limited by any of the exemplary combination game tables disclosed herein. The present invention has been described in terms of preferred embodiments and it is recognized that equivalents, alternatives, and modifications, aside from those expressly stated, are possible and within the scope of the appending claims. It is further recognized that a combination game table according to the present invention could be any size including a full-size combination game table.

While particular embodiments of the invention have been shown and described, those skilled in the art will appreciate that changes and modifications may be made without departing from the invention in its broader aspects, and therefore, the aim in the appended claims is to cover all such changes and modifications as fall within the true spirit and scope of the invention.

Therefore, the present invention includes a multi-game game table having a rotatable table with a first game formed on one side and another game formed on another side and a cavity therebetween. A frame extends about the rotatable table. A plug is attached to the rotatable table and is constructed to communicate power into the cavity of the rotatable table.

Another embodiment of the present invention includes combination game table having a first game surface and a second game surface. A frame supports the first game surface and the second game surface and has a space therein. An electrical device is disposed in the space of the frame and a plug is attached to the frame and is electrically connected to the electrical device.

A further embodiment of the present invention includes a rotatable game table having a table with one game formed on a first side and an air hockey game formed on a second side. An air blower is disposed between the one game and the air hockey game and has a discharge fluidly connected to the air hockey game. A power cord passes through the table and is electrically connected to the air blower.

The present invention has been described in terms of the preferred embodiment, and it is recognized that equivalents, alternatives, and modifications, aside from those expressly stated, are possible and within the scope of the appending claims.

What is claimed is:

1. A combination game table comprising:

a first game surface;

a second game surface;

a frame supporting the first game surface and the second game surface, and having a space therein;

an electrical device disposed in the space of the frame;

a plug positioned within the frame and electrically connected to the electrical device; and a cord reel connected between the plug and the electrical device wherein the cord reel is disposed in between the first game surface and the second game surface and the plug may be unspooled from the frame.

2. The combination game table of claim 1 further comprising a cover pivotably connected to the frame and constructed to expose the plug when the cover is rotated to an open position.

3. The combination game table of claim 1 wherein the cord reel further comprises a cord and a latch, the latch constructed to secure the cord in a plurality of positions between a fully extended position and a fully retracted position.

4. The combination game table of claim 3 wherein the cord reel further comprises a housing positioned thereabout and constructed to maintain a separation between a majority of the cord and the space.

5. The combination game table of claim 1 wherein the electrical device is an air blower, the air blower having an inlet in fluid communication with the space and an outlet in fluid communication with one of the first game surface and the second game surface.

6. The combination game table of claim 1 wherein the first game surface is one of a pool table, a billiards table, a table soccer table, an air hockey table, a gambling table, and a gaming table and the second game surface is another one of a pool table, a billiards table, a table soccer table, an air hockey table, a gambling table, and a gaming table.

7. A multi-game game table comprising:

a rotatable table having a first game formed on one side and another game formed on another side and having a cavity therebetween;

a frame extending about the rotatable table; and a plug attached to the rotatable table and constructed to communicate power into the cavity of the rotatable table.

8. The multi-game game table of claim 7 further comprising a power cord attached to the plug and retractably connected to the rotatable table.

9. The multi-game game table of claim 8 further comprising a recoil assembly attached to the rotatable table and constructed to support the power cord.

10. The multi-game game table of claim 9 wherein the recoil assembly further comprises a carriage rotatably attached thereto and constructed to receive the power cord thereon.

11. The multi-game game table of claim 10 further comprising a latch connected to the recoil assembly and constructed to secure the carriage in a desired position.

12. The multi-game game table of claim 7 further comprising a door attached to the rotatable table and constructed to cover the plug when the door is closed.

13. The multi-game game table of claim 7 wherein the plug further comprises:

a cavity;

a plurality of prongs extending into the cavity; and wherein the plurality of prongs are configured to engage an external electrical cord to receive power from a power supply.

14. A rotatable game table comprising:

a table having one game formed on a first side and an air hockey game formed on a second side;

an air blower disposed between the one game and the air hockey game and having a discharge fluidly connected to the air hockey game; and a power cord passing through the table and electrically connected to the air blower.

15. The rotatable game table of claim 14 further comprising a retractor assembly attached to the table and constructed to removably receive the power cord thereon.

16. The rotatable game table of claim 15 wherein the retractor assembly is securable in a plurality of positions and allows varied lengths of the power cord to remain extended from the table.

17. The rotatable game table of claim 14 wherein the one game is one of a pool game, a billiards game, a table soccer game, and a gambling game.

18. The rotatable game table of claim 14 further comprising a cover pivotably connected to the table and constructed to cover a plug of the power cord.

19. The rotatable game table of claim 18 wherein the cover further comprises a groove formed therein, the groove constructed to allow the power cord to pass through the cover when the cover is closed.

20. The multi-game game table of claim 18 wherein the plug further comprises:

a cavity;

a plurality of prongs extending into the cavity; and wherein the plurality of prongs are configured to engage an external electrical cord, the external electrical cord having a first end engageable with a power supply and a second end engageable with the cavity and the plurality of prongs.

* * * * *